US005702037A

United States Patent [19]

Merkel

[11] Patent Number: 5,702,037

[45] Date of Patent: Dec. 30, 1997

[54] PLEATING MACHINE AND METHOD

[76] Inventor: Ronald F. Merkel, 2010 Yorktown Ct. S., League City, Tex. 77573

[21] Appl. No.: 456,521

[22] Filed: Jun. 1, 1995

[51] Int. Cl.[6] ..... A41H 43/00

[52] U.S. Cl. ..... 223/30; 223/28

[58] Field of Search ..... 223/28, 29, 30, 223/31

[56] References Cited

U.S. PATENT DOCUMENTS

| | | | |
|---|---|---|---|
| 624,014 | 5/1899 | Hagerty | 223/30 |
| 1,723,688 | 8/1929 | Ezbelent | 223/30 |
| 1,770,590 | 7/1930 | Ezbelent | 223/30 |
| 1,789,421 | 1/1931 | Angelus | 223/30 |
| 3,390,218 | 6/1968 | Painter et al. | 223/30 |
| 3,473,706 | 10/1969 | Stahl . | |
| 3,633,800 | 1/1972 | Wallace . | |
| 3,822,034 | 7/1974 | Lawson . | |
| 4,465,213 | 8/1984 | Lehmann et al. . | |

FOREIGN PATENT DOCUMENTS

| | | | |
|---|---|---|---|
| 1810719 | 11/1968 | Germany | 223/28 |
| 575765 | 4/1958 | Italy | 223/29 |

OTHER PUBLICATIONS

WO 94/24357; 10–1994; PCT Document; Zenz; 223/30.

*Primary Examiner*—Bibhu Mohanty
*Attorney, Agent, or Firm*—Keeling Law Firm

[57] ABSTRACT

An improved pleating machine and method for creating a variety of pleated patterns that are not limited to repeating variation. Pairs of pleating blades move forward and rearward in a pleating motion. During the forward pleating motion, the pleating blades advance the material and create folds therein. The pleating blades then force the folds against heated cylinders resulting in pressed pleats in the material. Displacement of the pleating blades prior to the forward pleating motion causes a reverse pleat in the material; lack of such displacement causes a forward pleat. A cross-member moves to an engagement position and back to a resting position prior to each forward pleating motion. Switching devices, such as sliding blocks, slotted cams, or switch pins, attached to the cross-member selectively engage push-up rods which, in turn, selectively displace the coinciding pleating blades. The switching devices are electronically controlled to alternate positions. The method includes functionally applying the above-described pleating machine.

17 Claims, 3 Drawing Sheets

PLEATING MACHINE AND METHOD

BACKGROUND OF THE INVENTION

1. Field of Invention

This invention relates to a pleating machine. More specifically, it is directed to an improved pleating machine capable of creating controllable, nonrepeating pleated patterns in a material, particularly in a pleating machine of the "push-up" type.

Push-up pleating machines generally utilize a drum that has a discrete number of rows about the drum's circumference. Each of the drum rows contains a plurality of pins. During operation of the machine, the drum is displaced vertically. When the drum is displaced, the pins act on push-up rods which, in turn, displace coinciding blade pairs. If no pin in the drum coincides with a push-up rod, the vertical displacement of the drum does not result in displacement of the coinciding blade pairs. The displacement of the blade pairs causes a "reverse pleat" in the material being pleated. If a blade pair is not displaced, a "forward pleat" results. Therefore, by including or omitting pins in a drum row, the machine creates a row pattern.

Typically, push-up pleating machines are mechanically controlled. After each displacement and return of the drum, the drum rotates to the next sequential position so that upon the next subsequent drum displacement the next adjacent row of pins acts on the push-up rods. Thus, variation of the pin positions in each drum row creates a pleated pattern in the material.

However, because the drum must contain a discrete number of rows, the typical push-up pleating machine can only produce pleated material having a repeating pattern. In addition, alteration of the pattern produced by the pleating machine requires removal of the drum and replacement of the individual pins in different locations. Replacement of the drum is a labor intensive and costly operation and, therefore, deters variation of the patterns produced.

2. Related Art

Pleating machines have long been known to the prior art. Illustrative of such machines are U.S. Pat. Nos. 4,465,213 and 3,473,706.

Though the above referenced pleating machines may be useful for their intended purpose, neither of these machines provides a truly simple, low cost apparatus or method for creating nonrepeating pleating patterns in a material and for eliminating the need for the labor intensive drum replacement.

SUMMARY OF THE INVENTION

Accordingly, the objectives of this invention are to provide, inter alia, an improved pleating machine that:

- produces pleats in a material;
- provides for creation of nonrepeating pleating patterns in a material;
- eliminates the need for the labor intensive drum replacement;
- utilizes an inexpensive design that is a modification of a common push-up pleating machine;
- includes an apparatus for controlling the selective engagement and actuation of the pleating blades;
- uses existing push-up rod construction to facilitate pleating blade control;
- employs electronic control of the blades; and
- utilizes a single motion of a cross-member to selectively actuate all of the blades.

To achieve such improvements, my invention is an improved push-up pleating machine of the type that has a material extending between at least one pair of pleating blades. A material roller advances the material through the pleating machine. Corresponding to each pair of pleating blades, a push-up rod, having an upper end and a lower end, is positioned and constructed to engage the pair of pleating blades in response to a force applied thereto. A reciprocating means moves forcing the pleating blades into proximal pleating relation with a pair of heated cylinders. This motion creates folds in the material which, when pressed against the heated rollers, are pressed into pleats. The improvement to this machine is a push-up rod control means for selectively engaging and, thereby, applying a force to the push up rod during a pleating motion and for facilitating creation of a variation of pleated patterns that are not limited to repeating variation.

Implementing the above-described machine provides an improved method of pleating material.

BRIEF DESCRIPTION OF THE DRAWING

The manner in which these objectives and other desirable characteristics can be obtained is explained in the following description and attached drawings in which.

DETAILED DESCRIPTION OF THE INVENTION

Figure 1:
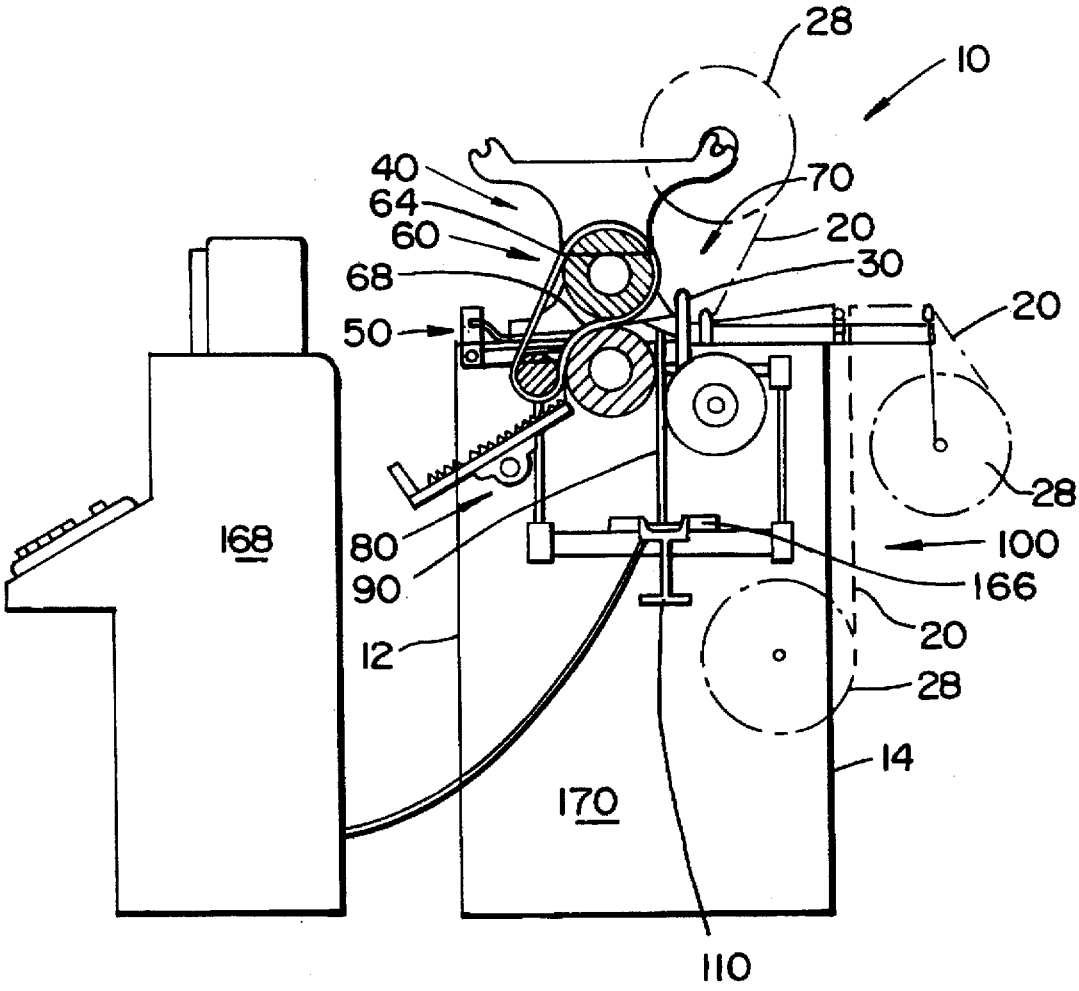
FIG. 1 is a partially cross-sectional side elevational view of the improved pleating machine.
Figure 2:
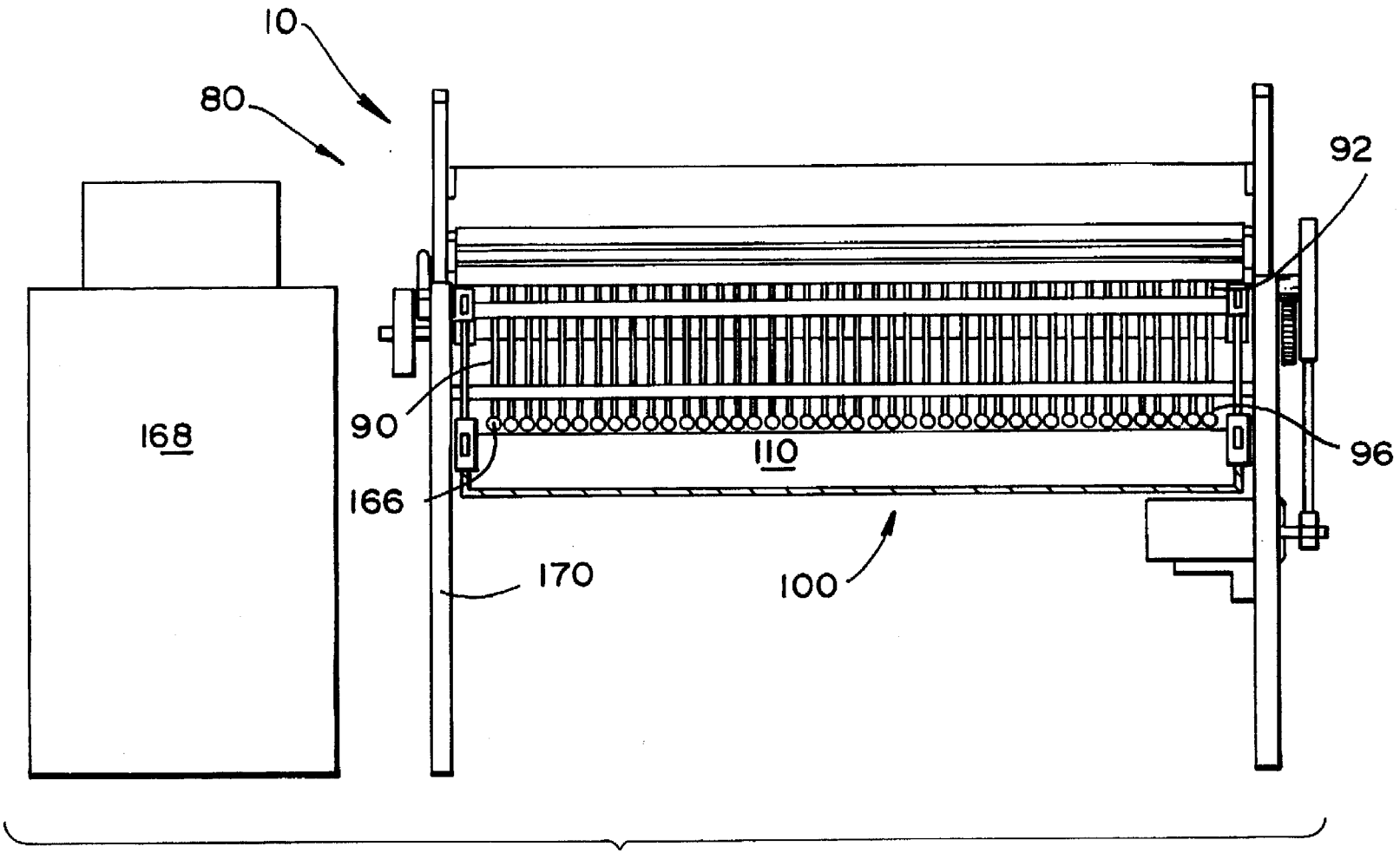
FIG. 2 is a partially cross-sectional front elevational view of the improved pleating machine.
Figures 3, 4, 5, 6:
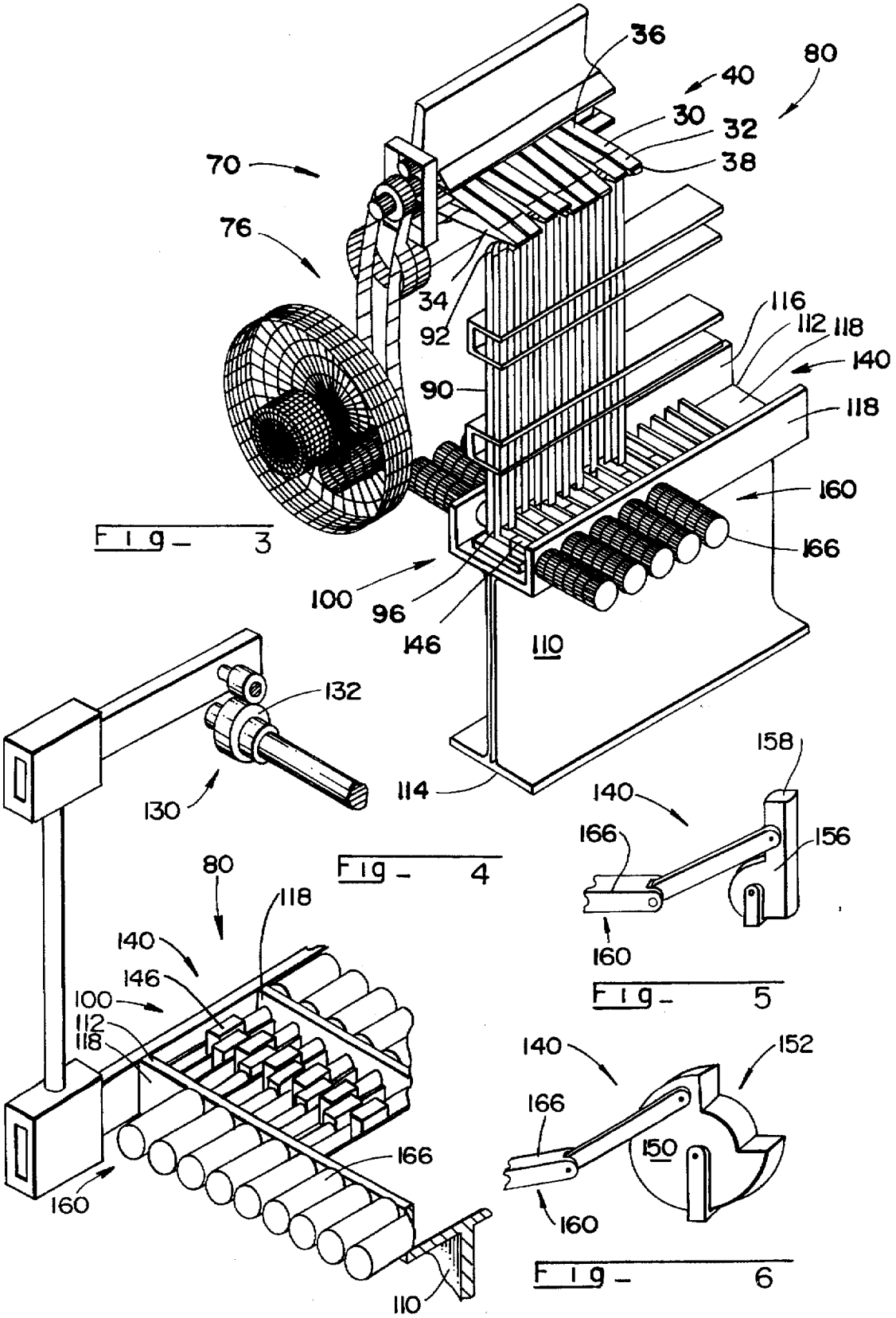
FIG. 3 is a partial isometric view of the pleating blades and the pleating blade controls.
FIG. 4 is a partial isometric view of the cross member displacement mechanism and the sliding blocks connected to solenoids and resting on the cross-member.
FIG. 5 is a partial isometric view showing a switch pin connected to a solenoid shaft.
FIG. 6 is a partial isometric view showing a slotted cam connected to a solenoid shaft.

The preferred embodiment of my invention is illustrated in FIGS. 1 through 6 and the improved pleating machine is depicted as 10. Generally, the pleating machine 10 has at least one pair of pleating blades 30, a pressing means 50, a reciprocating means 76, a pleating blade control means 80, a material advancement means 40, and a substantially rigid support structure 170.

For reference purposes, the description shall use the following references and conventions. The front side 12 of the pleating machine 10 is the side proximal the pair of heated cylinders 60 and distal the pairs of pleating blades 30. Accordingly, the rear side 14 of the pleating machine 10 is the opposing distal side from the front side 12. Forward refers to a direction toward the front side 12; and rearward refers to a direction toward the rear side 14.

Preferably, the pleating machine 10 incorporates a plurality of pairs of pleating blades 30. Each pair of pleating blades 30 includes an upper pleating blade 32 and a lower pleating blade 34 mounted with the support ends 36 of the pleating blades 30 in spaced proximal relation to one another. Each of the pleating blades 30 extends from its support end 36 in a forward direction. The pleating blades 30 are preferably thin, elongated strips of a flexible, resilient material that can withstand high temperatures without damage. In a pleating machine 10 having a plurality of pairs of pleating blades 30, the pleating blades 30 are preferably arranged in side-by-side abutment.

A material 20 to be pleated extends from a material source, such as a roll of material 28 between the upper pleating blade 32 and the lower pleating blade 34 and between a pair of heated cylinders 60. Commonly, the material 20 consists of two or more materials that extend through the pleating machine 10 in parallel abutment.

To provide for pressing of folds in the material into pleats, the pressing means 50 includes the pair of heated cylinders 60, an upper heated cylinder 64 and a lower heated cylinder 68, positioned and constructed for cooperative interaction with the pleating blades 30. When a fold in a material 20 presses against one of the heated cylinders 60, the combination of the heat and the pressure creates a pair of proximal creased folds, commonly referred to as a pleat. Structurally, the heated cylinders 60 include an elongated cylindrical body formed of a material that is resistant to heat and that is relatively a good thermal conductor. Generally, the support structure 170 maintains the heated cylinders 60 with their respective axes substantially horizontal and parallel to the other and with the heated cylinders 60 in proximal spaced relation to the other. The pair of pleating blades 30 is proximally oriented to the heated cylinders 60 and substantially equidistant from the upper heated cylinder 64 and the lower heated cylinder 68.

A folding means 70 creates folds in the material 20 proximal the pleating blade pairs' forward ends 38. Generally, the folding means includes a reciprocating means 76 of the pleating machine 10 in combination with a gripping action of the pleating blades 30. The reciprocating means 76 repeatedly moves the pleating blades 30 forward and rearward. Generally, the reciprocating means 76 comprises a known combination of a motor, gears, and other machine parts that provide for repeating motion. As the reciprocating means 76 moves the pairs of pleating blades 30 forward, the pleating blades 30 rotate to a closed position wherein the forward ends 38 of the pleating blades 30 move together to supply a pressure to and, thereby, grip the material 20. With the material 20 gripped, the forward motion of the pleating blades 30 pulls and advances the material 20. However, the material 20 in front of the pleating blades' 30 forward ends 38 does not advance. Therefore, the forward motion of the pleating blades 30 creates a fold proximal the forward end 38 of the pleating blades 30. At the end of the forward motion, reciprocating means presses the pleating blades 30 into proximal pleating relation to the pair of heated cylinders 60. In this position, the pleating blades 30 supply a pressure to the folded material 20 and force the material 20 against the heated cylinders 60. In this way, the folds are pressed into pleats.

The material advancement means 40 advances the material 20 through the pleating machine 10 in two stages. First, the pleating blades 30 advance the material 20 during their forward motion as described above. The pleating blades 30 then move rearward and rotate to an open position wherein the forward ends 38 move away from one another and release the pressure on the material 20. During the rearward motion of the pleating blades 30, the heated cylinders 60 rotate and advance the material 20.

To provide for variation of the pleated patterns produced by the pleating machine 10, the pleating machine can create both forward pleats and reverse pleats. To create the variations, the forward ends 38 of each pair of pleating blades 30 are selectively temporarily displaced while the pleating blades 30 grip the material 20. The displacement stretches the material 20 causing the material 20 to fold in a direction opposite the typical folding direction resulting in a reverse pleat.

The focus of the present invention lies in the control of the displacement of the pleating blades 30. A pleating blade control means 80 selectively moves the pleating blades 30 during a pleating motion and, thereby, facilitates creation of a variation of pleated patterns that are not limited to repeating variation. The pleating blade control means 80 includes a cross member 110, a cross-member displacement means 130, a selective engagement means 140, and an engagement control means 160. In a pleating machine 10 of the push-up type, the pleating blade control means 80 is referred to as a push-up rod control means 100.

In general, the cross member 110 is an elongated body supported by the support structure 170 that extends substantially horizontally parallel to the pleating blade forward ends 38 in spaced relation therebelow. In the preferred embodiment, the cross-member 110 comprises an I-beam. Extending from cross-member top end 112, support extension walls 118 define a land area on the cross-member upper surface 116.

The cross-member displacement means 130 vertically displaces the cross member 110 for each pleating motion from a cross-member resting position to a cross-member engagement position and back. Typically, the cross-member displacement means 130 utilizes a rotating elliptical cam 132 connected to the cross-member 110 to accomplish the repeating movement.

The selective engagement means 140 is for selectively engaging or not engaging the pairs of pleating blades 30. The engagement control means 160 is for controlling the selective engagement of the selective engagement means 140. Preferably, the engagement control means 160 comprises an electronically-controlled solenoid 166 for each of the pairs of pleating blades 30. To supply convenient control of the solenoids 166, a computer 168 directs the actuation of the solenoids 166.

In a pleating machine 10 of the push-up type, the selective engagement means 140 comprises a push-up rod 90 that corresponds to each pair of pleating blades 30. The push-up rod 90 has an upper end 92 constructed and positioned to engage the corresponding pair of pleating blades 30 in response to a force applied to lower end 96 of the pleating blades 30. Thus, the push-up rod 90 is slidable supported by the support structure 170. In addition to the push-up rods 90, the selective engagement means 140 includes a device corresponding to each push-up rod 90 for transferring the force associated with the upward motion of the cross-member 110 to the push-up rod 90. In other words, the device translates upward motion of the cross-member 110 into upward motion of the push-up rod 90 which results in a displacement of the corresponding pair of pleating blades 30.

This device may take a variety of designs. A description of three such designs, the block design, the cam design, and the pin design, follows. In the block design, a block 146 corresponding to each pair of pleating blades 30 slidably abuts the cross-member upper surface 116. A solenoid 166 attached to each of the blocks 146 selectively forces the block 146 to slide alternatively between a first reverse pleat position and a second forward pleat position. In the first reverse pleat position, the block 146 contacts the rod lower end 96 when the cross-member 110 is in the cross-member engagement position. Therefore, in the first pleat position, the corresponding pleating blades 30 displace, stretch the material, and create a reverse pleat. In the second forward pleat position, the block 146 does not contact the rod lower end 96 when the cross-member 110 is in the cross-member engagement position. Consequently, the corresponding pleating blades 30 create a forward pleat because the pleating blades 30 do not displace.

In the cam design, a slotted cam 150 corresponding to each of the pairs of pleating blades 30 is rotatably attached to the cross-member top end 112. A solenoid 166 attached to the slotted cam 150 selectively rotates the slotted cam 150 into a first reverse pleat position and a second forward pleat position. In the first reverse pleat position, the slot 152 of the slotted cam 150 is aligned with the rod lower end 96. Thus, the slotted cam 150 does not abut the rod lower end 96 when the cross-member 110 is in the cross-member engagement position and a reverse pleat results. However, in the second forward pleat position, the slot 152 of the slotted cam 150 is not aligned with the rod lower end 96. Therefore, the slotted cam 150 abuts the rod lower end 96 when the cross-member 110 is in the cross-member engagement position resulting in a forward pleat.

Finally, in the pin design, a switch pin 156 corresponds to each pair of pleating blades 30. The switch pin 156 is rotatably attached to the cross-member top end 112. A solenoid 166 attached to the switch pin 156 selectively rotates the switch pin 156 alternatively between a first reverse pleat position and a second forward pleat position. The switch pin 156 has an elongated body and an engagement end 158 sized and constructed to mate with the rod lower end 96 of the coinciding push-up rod 90. When in the first reverse pleat position, the switch pin 156 is horizontally oriented such that the switch pin 156 does not engage the rod lower end 96 when the cross-member 110 is in the cross-member engagement position. When the solenoid 166 rotates the switch pin 156 into the second forward pleat position, the engagement end 158 of the switch pin 156 abuts the lower rod end 96 when the cross-member 110 is in the cross-member engagement position.

An improved method of pleating material comprises functionally applying the above-described pleating machine 10. Application of the pleating machine 10 includes providing a material 20 in the pleating machine 10 and directing the engagement control means 160 using a control program.

I claim:

1. An improved push-up pleating machine of the type having:

a material extending between a plurality of pairs of pleating blades;

a material advancement means for advancing said material through said pleating machine;

a corresponding push-up rod for each of said plurality of pairs of pleating blades;

said push-up rod having a rod upper end and a rod lower end;

said rod upper end positioned and constructed to engage said corresponding pair of pleating blades in response to a force applied to said push-up rod and, thereby, creating a reverse pleat;

a pair of heated cylinders;

reciprocating means for pushing said plurality of pairs of pleating blades into proximal pleating relation to said pair of heated cylinders and, thereby, folding said material and pressing the resultant folds into pleats;

wherein the improvement comprises:

a push-up rod control means for selectively engaging and, thereby, applying a force to said push-up rods during a pleating motion and for facilitating creation of lateral variation and longitudinal variation of forward pleats and reverse pleats that are not limited to repeating variation and, thus, a variation of pleated patterns that are not limited to repeating variation;

a cross-member;

cross-member displacement means for repeatedly moving said cross-member from a cross-member resting position to a cross-member engagement position and back to said cross-member resting position;

selective engagement means for selectively engaging said rod lower end of any of said push-up rods when said cross-member is in said cross-member engagement position; and engagement control means for controlling selective engagement of said selective engagement means.

2. An improved push-up pleating machine as claimed in claim 1 wherein said engagement control means comprises at least one electronically-controlled solenoid.

3. An improved push-up pleating machine as claimed in claim 2 wherein said selective engagement means comprises:

at least one block slidably abutting said cross-member;

each of said at least one blocks attached to one of said at least one solenoids;

said at least one solenoid selectively forcing said at least one block into a first reverse pleat position to facilitate creation of a reverse pleat; and said at least one solenoid selectively forcing said at least one block into a second forward pleat position to facilitate creation of a forward pleat.

4. An improved push-up pleating machine as claimed in claim 2 wherein said selective engagement means comprises:

at least one slotted cam rotatably affixed to said cross-member;

each of said at least one slotted cams attached to one of said at least one solenoids;

said at least one solenoid selectively forcing said at least one slotted cam into a first reverse pleat position to facilitate creation of a reverse pleat; and said at least one solenoid selectively forcing said at least one slotted cam into a second forward pleat position to facilitate creation of a forward pleat.

5. An improved push-up pleating machine as claimed in claim 2 wherein said selective engagement means comprises:

at least one switch pin rotatably mounted on said cross-member;

each of said at least one switch pin attached to one of said at least one solenoids;

said at least one solenoid selectively forcing said at least one switch pin into a first reverse pleat position to facilitate creation of a reverse pleat; and said at least one solenoid selectively forcing said at least one switch pin into a second forward pleat position to facilitate creation of a forward pleat.

6. An improved pleating machine comprising:

a plurality pairs of pleating blades;

a pair of heated cylinders;

reciprocating means for pushing said plurality of pairs of pleating blades into proximal pleating relation to said pair of heated cylinders and, thereby, folding a material and pressing the resultant folds into pleats;

a pleating blade control means for selectively displacing said plurality of pairs of pleating blades during a pleating motion and for facilitating creation of lateral variation and longitudinal variation of forward pleats and reverse pleats that are not limited to repeating variation and, thus, of a variation of pleated patterns that are not limited to repeating variation; and a material advancement means for advancing said material through said pleating machine;

a cross-member;

cross-member displacement means for repeatedly moving said cross-member from a cross-member resting position to a cross-member engagement position and back to said cross-member resting position;

selective engagement means for selectively engaging said plurality of pairs of pleating blades when said cross-member is in said cross-member engagement position; and engagement control means for controlling selective engagement of said selective engagement means.

7. An improved pleating machine as claimed in claim 6 wherein said engagement control means comprises at least one electronically-controlled solenoid.

8. An improved pleating machine as claimed in claim 7 wherein said selective engagement means comprises:

a corresponding at least one push-up rod for each said at least one pleating blade;

said at least one push-up rod having a rod upper end and a rod lower end; and said at least one push-up rod upper end positioned and constructed to engage said corresponding plurality of pairs of pleating blades in response to a force applied to said at least one push-up rod and, thereby, creating a reverse pleat.

9. An improved pleating machine as claimed in claim 8 wherein said selective engagement means comprises:

at least one block slidably abutting said cross-member;

each of said at least one blocks attached to one of said at least one solenoids;

said at least one solenoid selectively forcing said at least one block into a first reverse pleat position to facilitate creation of a reverse pleat; and said at least one solenoid selectively forcing said at least one block into a second forward pleat position to facilitate creation of a forward pleat.

10. An improved pleating machine as claimed in claim 8 wherein said selective engagement means comprises:

at least one slotted cam rotatably affixed to said cross-member;

each of said at least one slotted cams attached to one of said at least one solenoids;

said at least one solenoid selectively forcing said at least one slotted cam into a first reverse pleat position to facilitate creation of a reverse pleat; and said at least one solenoid selectively forcing said at least one slotted cam into a second forward pleat position to facilitate creation of a forward pleat.

11. An improved pleating machine as claimed in claim 8 wherein said selective engagement means comprises:

at least one switch pin rotatably mounted on said cross-member;

each of said at least one switch pin attached to one of said at least one solenoids;

said at least one solenoid selectively forcing said at least one switch pin into a first reverse pleat position to facilitate creation of a reverse pleat; and said at least one solenoid selectively forcing said at least one switch pin into a second forward pleat position to facilitate creation of a forward pleat.

12. An improved pleating machine comprising:

a plurality of pleating blade pairs;

a folding means for creating folds in a material proximal said plurality of pleating blade pairs;

a pressing means for cooperative mating with said plurality of pleating blade pairs to facilitate pressing of folds and, thereby, creation of pleats;

a cross-member;

pleating blade control means for selectively lifting any of said plurality of pleating blade pairs in response to a single pleating motion of said cross-member and for facilitating creation of lateral variation and longitudinal variation of forward pleats and reverse pleats that are not limited to repeating variation and, thus, a variation of pleated patterns that are not limited to repeating variation;

cross-member displacement means for repeatedly moving said cross-member from a cross-member resting position to a cross-member engagement position and back to said cross-member resting position;

selective engagement means for selectively engaging said plurality of pairs of pleating blades when said cross-member is in said cross-member engagement position; and engagement control means for controlling selective engagement of said selective engagement means; and a material advancement means for advancing said material through said pleating machine.

13. An improved push-up pleating machine as claimed in claim 12 wherein said engagement control means comprises a plurality of electronically-controlled solenoids.

14. An improved push-up pleating machine as claimed in claim 13 wherein said selective engagement means comprises:

a plurality of push-up rods;

each of said plurality of push-up rods corresponding to one of said plurality of pleating blade pairs;

each of said plurality of push-up rods having a rod upper end and a rod lower end; and said rod upper end positioned and constructed to engage said corresponding one of said plurality of pleating blade pairs in response to a force applied to one of said corresponding plurality of push-up rods and, thereby, creating a reverse pleat.

15. An improved push-up pleating machine as claimed in claim 14 wherein said selective engagement means comprises:

a plurality of blocks slidably abutting said cross-member;

each of said plurality of blocks attached to one of said plurality of solenoids;

each of said plurality of solenoids selectively forcing said corresponding plurality of blocks into a first reverse pleat position to facilitate creation of a reverse pleat; and each of said plurality of solenoids selectively forcing said corresponding plurality of blocks into a second forward pleat position to facilitate creation of a forward pleat.

16. An improved push-up pleating machine as claimed in claim 14 wherein said selective engagement means comprises:

a plurality of slotted cams rotatably affixed to said cross-member;

each of said plurality of slotted cams attached to one of said plurality of solenoids;

each of said plurality of solenoids selectively forcing said corresponding plurality of slotted cams into a first reverse pleat position to facilitate creation of a reverse pleat; and each of said plurality of solenoids selectively forcing said corresponding plurality of slotted cams into a second forward pleat position to facilitate creation of a forward pleat.

17. An improved push-up pleating machine as claimed in claim 14 wherein said selective engagement means comprises:

a plurality of switch pins rotatably mounted on said cross-member;

each of said plurality of switch pins attached to one of said plurality of solenoids;

each of said plurality of solenoids selectively forcing said corresponding plurality of switch pins into a first reverse pleat position to facilitate creation of a reverse pleat; and each of said plurality of solenoids selectively forcing said corresponding plurality of switch pins into a second forward pleat position to facilitate creation of a forward pleat.

* * * * *